United States Patent [19]

Strong et al.

[11] 4,101,042

[45] Jul. 18, 1978

[54] BOTTLE DISC

[75] Inventors: Lawrence M. Strong, Solon; Chester H. Rilling, Ravenna, both of Ohio

[73] Assignee: Questor Corporation, Toledo, Ohio

[21] Appl. No.: 812,648

[22] Filed: Jul. 5, 1977

[51] Int. Cl.[2] ..... A61J 9/06

[52] U.S. Cl. ..... 215/11 R; 206/806; 215/228; 215/100 R; 248/102

[58] Field of Search ..... 215/11 R, 228, 100 R, 215/100 A; 206/806; 248/102, 103, 318, 359, 360; 211/74, 75, 76

[56] References Cited

U.S. PATENT DOCUMENTS

| | | | |
|---|---|---|---|
| 2,635,604 | 4/1953 | Fredrickson | 215/100 R UX |
| 2,760,665 | 8/1956 | Zenker | 215/11 R |
| 3,299,442 | 1/1967 | White | 215/100 R X |
| 3,302,917 | 2/1967 | Winkler | 206/806 X |
| 3,387,732 | 6/1968 | Jellies | 248/359 X |
| 3,744,658 | 7/1973 | Fujio | 215/100 A |

FOREIGN PATENT DOCUMENTS

| | | | |
|---|---|---|---|
| 93,867 | 10/1962 | Denmark | 215/11 R |

*Primary Examiner*—Donald F. Norton
*Attorney, Agent, or Firm*—Donald R. Bahr; John E. Benoit

[57] ABSTRACT

A disc for use between a bottle body and a cap having an aperture therein. The disc has a substantially planar base which fits within the cap and a circular plate on the base which mates with the aperture in the cap. An elongated land extends across the circular plate and slightly beyond. The ends of the land are tapered so as to provide a snap fit of the disc to the cap. A tab is secured to the land by a flexible hinge. An aperture is provided through the tab so that the assembled structure may be hung from a rod.

3 Claims, 4 Drawing Figures

BOTTLE DISC

BACKGROUND OF THE INVENTION

This invention relates generally to baby bottle discs used between the cap and cover of the baby bottle and, more specifically, to a baby bottle disc incorporating means for hanging the bottle for display purposes and the like.

All standard baby bottles are shipped with the nipple inverted into the bottle and a cap securing a portion of the nipple in that position by screwing the cap onto the threaded part of the bottle. Normally, a removable disc is also placed within the cap so as to cover the opening that must be in the cap in order to accomodate the nipple when it is turned around for use in nursing.

One of the problems inherent in this type of bottle is providing a means for conveniently displaying the bottles in the retail stores. The normal procedure is to use a header card and merely place the bottles on a shelf or some type of holder. This takes considerable space and does not conveniently display the bottles and make them readily accessible to the buyer.

With the type of bottle that has a temporary sleeve which includes the name of the product and the advertising thereon, it would be advantageous to be able to hang the bottle during display on a means such as a J-hook so that several bottles could be easily accessible and would still provide their own display of identification and advertisement of the product.

Proposals have been made to supply a separate hook which would grasp the neck of the bottle so that it may be hung for display. Other proposals, although not necessarily in the baby bottle field, relate to structure wherein a portion of the disc itself be struck so as to extend upwardly and provide a means for hanging the bottle. In the first instance, the disadvantages are obvious in that it requires that the retailer be provided with hangers which are not an integral part of the item that is sold or, if it is made an integral part of the item, there would obviously be an additional cost added to the item. The disadvantage to the second method mentioned above, particularly in the baby bottle field, is that it would leave the bottle and the nipple open to the air and would not maintain a closed sanitary bottle which obviously appeals to many purchasers.

SUMMARY OF THE INVENTION

Accordingly, the present invention provides a disc for use with a baby bottle and cap having an aperture therein wherein the disc comprises a substantially planar base having a diameter smaller than the diameter of the interior of the cap. A circular plate is mounted on the planar base and is of a dimension to mate within the aperture of the cap. An elongated land is mounted on the circular plate and extends outwardly therefrom. This land is tapered at each end and extends beyond the land, and thus beyond the aperture in the cap, whereby it may be snapped into position so as to maintain the base within the aperture of the cap. A tab having an aperture therethrough is mounted to the land by the means of a flexible hinge. The disc may be cast as an integral unit so as to be easily manufactured. Additionally, the flexible hinge allows the tab to be bent flat so that shipping problems are basically overcome.

BRIEF DESCRIPTION OF THE DRAWINGS

The objects and advantages of this invention will become obvious from the following description taken in conjunction with the drawings wherein.

DETAILED DESCRIPTION OF A PREFERRED EMBODIMENT OF THE INVENTION

Figure 1:
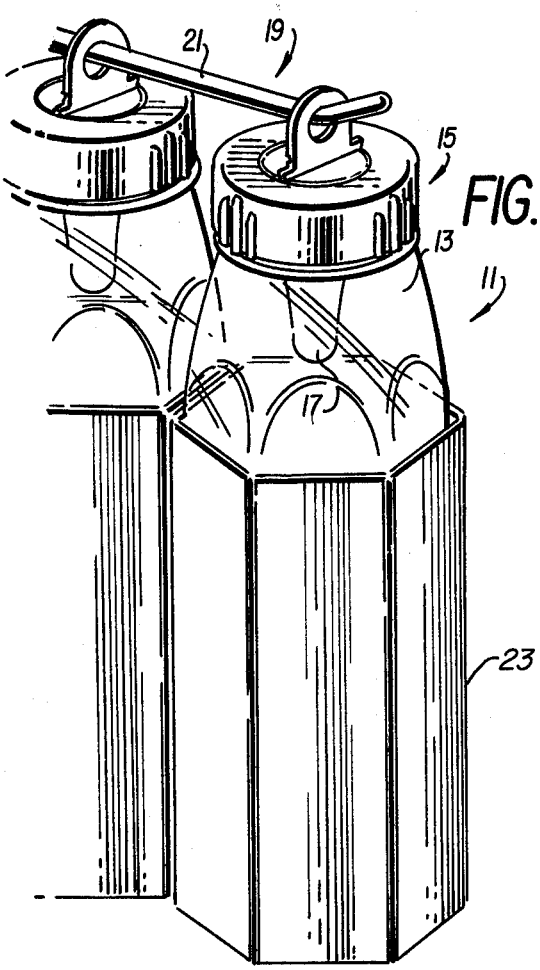
FIG. 1 is a perspective view of bottles using the disc of the present invention shown hung for display purposes.

FIG. 1 discloses the primary use of the present invention wherein the assembled baby bottle 11 comprising the bottle body 13, the cap 15, the nipple 17 and the disc 19 is shown hung from a display bar 21 which may be used by the retailer. This type of bottle has a sleeve 23 which serves the purpose of protecting the bottle and providing the identification and advertising for the particular bottle used. It is quite obvious that this display system provides advantages over storing the bottles on shelves and the like, not only from a standpoint of saving space, but also by providing a greater convenience to the customer.

Figure 2:
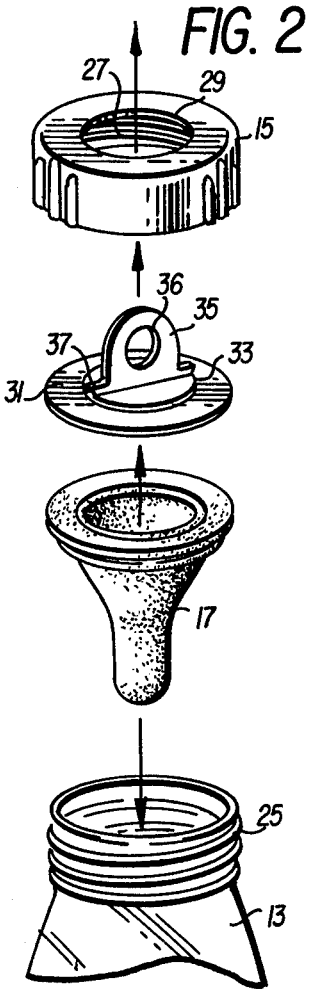
FIG. 2 is an exploded view showing the relationship between the bottle neck, the nipple, the disc and the cap.

FIG. 2 is an exploded view showing a portion of the bottle body 13 and the threaded neck 25. The relationship of the disc 19 relative to the nipple 17 and the cap 15 is indicated by the arrows which show the manner in which the bottle is assembled.

Figure 3:
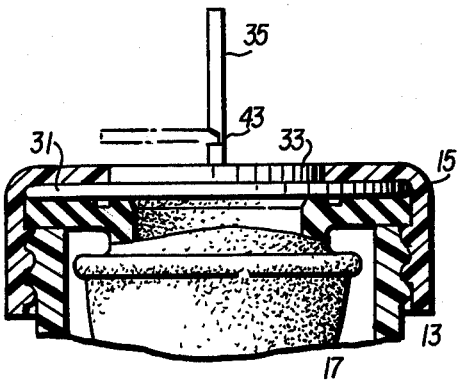
FIG. 3 is a sectional view taken through the bottle and cap showing an end view of the disc.
Figure 4:
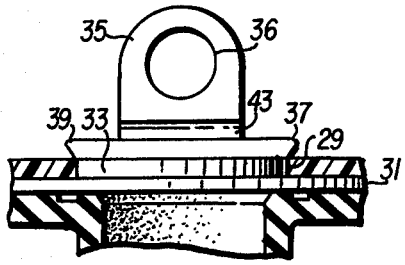
FIG. 4 is a view similar to FIG. 3 showing a side view of the disc.

Referring now specifically to the details of the disc as shown in FIGS. 2, 3 and 4, it can be seen that the disc has a substantially planar base 31. A circular plate 33 extends upwardly from the base and also terminates in a substantially flat face. The base 31 fits within the interior of the cap 15 and is, therefore, of a diameter which will allow it to recess within the interior.

The circular plate 33 is of a dimension so as to mate with the aperture 29 in the cap when the bottle is assembled. A land 37 extends upwardly and across circular plate 33. This land terminates at either end in tapered ends which are formed by undercutting the land and rounding the edges thereof. As can be seen more clearly in FIG. 4, the land extends slightly beyond the circular plate and, therefore, extends outwardly so as to be slightly longer than the diameter of the hole 29 in the cap 15. This allows the disc to be forced upwardly and snapped into position whereby the land 37 holds the disc within the cap and may be removed therefrom by snapping it in the other direction. When the cap and disc are threaded onto the bottle neck, the outer periphery of the base is secured between the cap and the bottle neck with the nipple therebetween.

A tab 35 has an aperture 36 therethrough for placing the disc and bottle on the rack as shown in FIG. 1. This tab is connected to the land 37 by means of a flexible hinge 43. The purpose of having the flexible hinge 43 is to allow the tab to be bent downwardly to a position such as shown on dotted lines in FIG. 3. This greatly reduces the space needed for shipping the bottles as opposed to having an upwardly extending rigid tab.

Preferably, the entire disc is molded so as to be of an integral construction. The material is preferably of a semi-rigid plastic as is the cap of the bottle. This provides the necessary flex for the snap action of the disc when mated with the cap and also provides a very practical flexible hinge 43 wherein there is a reduced cross sectional area between the tab 35 and the land 37.

It should be noted that the disc may also be of use to the purchaser if she should wish to store it in the refrigerator with a formula for later use. A bar, such as bar 21, could be mounted within the refrigerator so that the bottles could be hung in this manner and not take up any shelf space.

It is to be understood that the above description and drawings are illustrative only since certain details could be changed and equivalents could be substituted without departing from the invention. Accordingly, the scope of the invention is to be limited only by the following claims.

I claim:

1. A disc for use with a baby bottle and a cap having an aperture therein, said disc comprising a substantially planar base having a diameter smaller than the diameter of the interior of said cap;

a circular plate mounted on said planar base, said plate being of a dimension to mate within said aperture in said cap;

an elongated land mounted on said plate and extending outwardly therefrom, said land being tapered at each end and extending beyond said plate whereby said land removably maintains said plate within said aperture in said cap;

a tab having an aperture therethrough; and a flexible hinge connecting said tab to said land.

2. The disc of claim 1 wherein said base, said plate, said land, said tab and said flexible hinge form an integral unit.

3. The disc of claim 1 wherein said flexible hinge comprises a reduced cross-sectional area smaller than that of said land and said tab.

* * * * *